US012523026B2

(12) United States Patent
Liao et al.

(10) Patent No.: US 12,523,026 B2
(45) Date of Patent: Jan. 13, 2026

(54) SHOWER HOLDER

(71) Applicant: Clement Inc., Flushing, NY (US)

(72) Inventors: Xingfa Liao, Wuhan (CN); Chunhua Wang, Wuhan (CN); Changzheng Ni, Shanghai (CN); Yongqiang Yan, Shanghai (CN)

(73) Assignee: CLEMENT INC., Flushing, NY (US)

( * ) Notice: Subject to any disclaimer, the term of this patent is extended or adjusted under 35 U.S.C. 154(b) by 114 days.

(21) Appl. No.: 18/520,080

(22) Filed: Nov. 27, 2023

(65) Prior Publication Data

US 2025/0171991 A1 May 29, 2025

(51) Int. Cl.

| | |
|---|---|
| ***E03C 1/06*** | (2006.01) |
| ***E03C 1/04*** | (2006.01) |
| ***E03D 9/08*** | (2006.01) |

(52) U.S. Cl.
CPC ..... *E03C 1/06* (2013.01); *E03C 1/0408* (2013.01); *E03D 9/085* (2013.01)

(58) Field of Classification Search
CPC ..... E03C 1/06; E03C 1/0408; E03D 9/085
See application file for complete search history.

(56) References Cited

U.S. PATENT DOCUMENTS

| | | | | |
|---|---|---|---|---|
| 9,637,905 | B2 * | 5/2017 | Hauth | E03C 1/0408 |
| 10,532,369 | B2 * | 1/2020 | Quinn | E03C 1/025 |

FOREIGN PATENT DOCUMENTS

TW 653068 U * 3/2024

* cited by examiner

*Primary Examiner* — Jennifer C Chiang

(57) ABSTRACT

A shower holder includes a main body and a plug-in element. The main body includes a water inlet part, a water outlet part, and a first connecting part located far away from the water inlet part, and the second connecting part including a plurality of fitting teeth arranged uniformly. The plug-in element includes a second connecting part, and a plurality of positioning teeth uniformly distributed on an outside of the second connecting part. The plurality of positioning teeth are provided corresponding to the plurality of fitting teeth so that the plug-in element is rotatably connected to the main body.

12 Claims, 4 Drawing Sheets

SHOWER HOLDER

TECHNICAL FIELD

The present disclosure relates to a field of bathroom products, especially a shower holder.

BACKGROUND

In the prior art, a shower holder is installed on a wall of a bathroom to support a hand-held shower head. Some bathrooms also use a water outlet pipe located in the wall to connect with a shower head. However, in other situations, some products will combine the shower holder and the water outlet pipe located in the wall together. That is to say, the shower holder located on the wall needs to pass through water and provide a storage location for the hand-held shower head. However, there are no similar products in existing prior art.

SUMMARY OF THE DISCLOSURE

The present disclosure provides a shower holder.

In a first aspect, A shower holder comprising:

a main body comprising a water inlet part, a water outlet part, and a first connecting part located far away from the water inlet part, and the first connecting part comprising a plurality of fitting teeth arranged uniformly;

a plug-in element comprising a second connecting part, and a plurality of positioning teeth uniformly distributed on an outside of the second connecting part, wherein the plurality of positioning teeth are provided corresponding to the plurality of fitting teeth so that the plug-in element is rotatable connected to the main body.

The shower holder of the present embodiment not only can pass through water, but also can provide a place for plugging-in the hand-held shower head. Therefore, a space of the bathroom can be saved. Furthermore, a threaded connection is formed between the main body and the plug-in element, ensuring that the connection structure between the main body and the plug-in element is strong enough and fail to shake, and has a longer service life. An angle of the main body can be adjusted by the threaded connection, to make sure that an angle of a hand-held shower head located therein can be also adjusted. Therefore, it can meet the needs of different users.

BRIEF DESCRIPTION OF THE DRAWINGS

The accompanying drawings described here are intended to provide a further understanding of the present disclosure and form a part of the present disclosure. The schematic embodiments and explanations of the present disclosure are configured to explain the present disclosure and do not constitute an improper limitation of the present disclosure.

DETAILED DESCRIPTION

Figure 1:
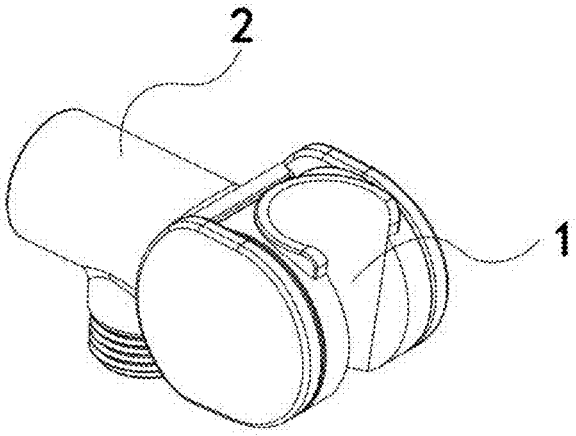
FIG. 1 shows an elevation view of an embodiment of the present invention.
Figure 2:
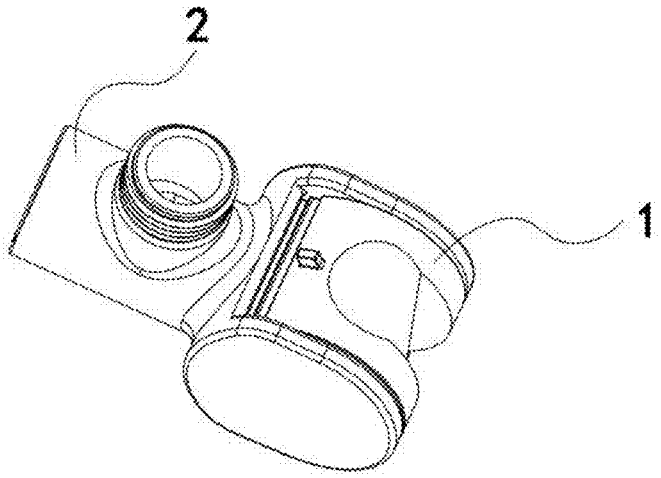
FIG. 2 shows anther elevation view of an embodiment of the present invention.

In order to make the technical problems, technical solutions, and beneficial effects to be solved by the present disclosure clearer, the present disclosure may be further explained in detail in conjunction with the accompanying drawings and embodiments. It should be understood that the specific embodiments described here are only intended to explain the present disclosure and are not intended to limit the present disclosure.

Referring to FIGS. 1-8, a shower holder of the present embodiment comprises a main body 2 and a plug-in element 1 rotatably around the main body 2. The main body 2 comprises a water inlet part 21, a water outlet part 23, and a first connecting part 24 located far away from the water inlet part 21, and the first connecting part 24 comprises a plurality of fitting teeth 25 arranged uniformly. The plug-in element 1 comprising a second connecting part 11, and a plurality of positioning teeth 14. The plurality of positioning teeth 14 is uniformly distributed on an outside of the second connecting part 11, wherein the plurality of positioning teeth 14 are provided corresponding to the plurality of fitting teeth 25 so that the plug-in element 1 is rotatable connected to the main body 2. Wherein the water inlet part 21 of the main body 2 can be built in the wall and can be connected to an outer water inlet. The plug-in element 1 can be used to plug-in a hand-held shower head. Water can sequentially pass through the water inlet part 21 and water outlet part 23 to reach the hand-held shower head.

The shower holder further comprises a gasket 3 arranged in the water inlet part 21 of the main body 2. The gasket 3 is used to guiding connect the water inlet part 21 to the outer water inlet.

The shower holder can be installed on a wall and be connected to the hand-held shower head. Specifically, a water inlet of the hand-held shower head can be connected to the water outlet part 23, and the hand-held shower head can be handed on the plug-in element 1.

The main body 2 further comprises a water passage located between the water inlet part 21 and the water outlet part 23. An inside wall of the water inlet part 21 away from the second connecting part 11 comprises an internal thread 22. So that, the main body 2 can be threaded to the outer water inlet. The water outlet part 23 comprises an external thread 231, which can be threaded to a connecting pipe of the hand-held shower head.

In some embodiments, an angle $\beta$ is formed between an axis of the water inlet part 21 and an axis of the water outlet part 23, to make sure that the outer water inlet can't interfere with the connecting pipe of the hand-held shower head. The angle $\beta$ ranges from 80 degrees to 120 degrees. Preferably, the angle $\beta$ ranges from 85 degrees to 100 degrees. In one embodiment, the angle $\alpha$ is about 95 degrees.

Figure 6:
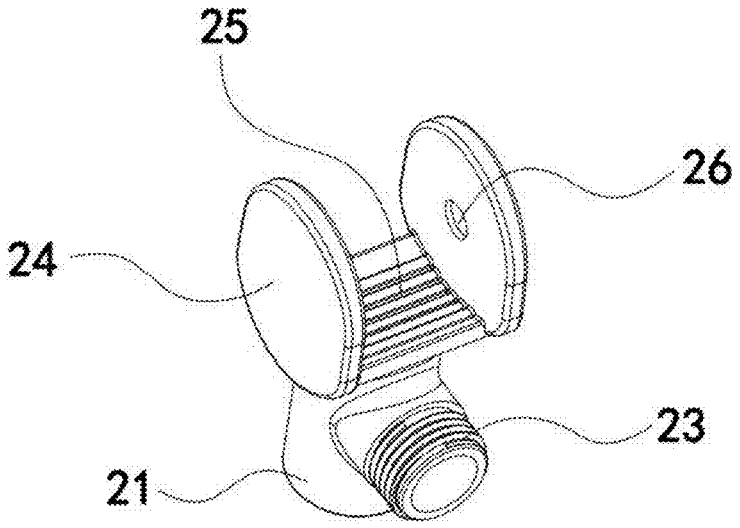
FIG. 6 shows an elevation view of the main body of the embodiment of the present invention.

Referring to FIG. 6, the first connecting part 24 comprises a first end 28 and two connection ends 29 respectively located at two sides of the first end 28. The first end 28 is connected to the water inlet part 21, and the plurality of the fitting teeth 25 are located on a side wall of the first end 28 away from the water inlet part 21. In one embodiment, the side wall of the first end 28 comprises a first circular arc surface, and the plurality of fitting teeth 25 are uniformly distributed on the first circular arc surface.

Figure 5:
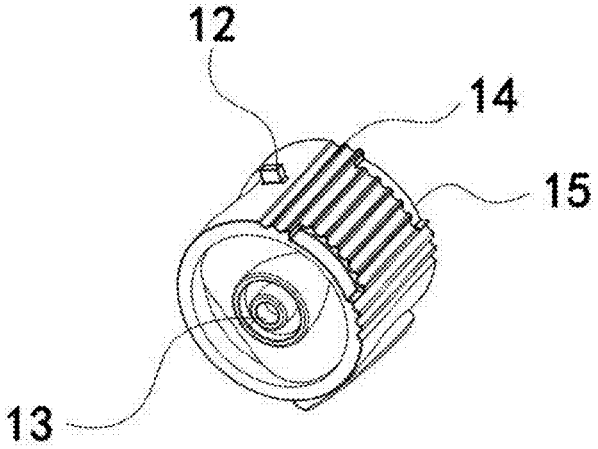
FIG. 5 shows an elevation view of a plug-in element according to an embodiment of the present invention.

Referring to FIG. 5, the second connecting part 11 comprises an outside wall surface, which is a second circular arc surface corresponding to the first circular arc surface. And the plurality of the positioning teeth 14 are uniformly distributed on the second circular arc surface and corresponding to the plurality of fitting teeth 25, so that the plug-in element 1 and the main body 2 can be relatively rotatably connected. When the plurality of positioning teeth 14 move on the plurality of fitting teeth 25, they can move in conformity with the arc surface structure cooperating with each other and can be stably positioned by the plurality of positioning teeth 14 and the plurality of fitting teeth 25.

In order to ensure that the plug-in element 1 and the first connecting part 24 can freely rotate with each other, two connection ends 29 further comprises a rotation shaft hole 26, and the plug-in element 1 further comprises a rotation shaft 13 rotatably connected to the rotation shaft hole 26, so as to achieve the rotatable connection between the plug-in element 1 and the first connecting part 24.

Figure 3:
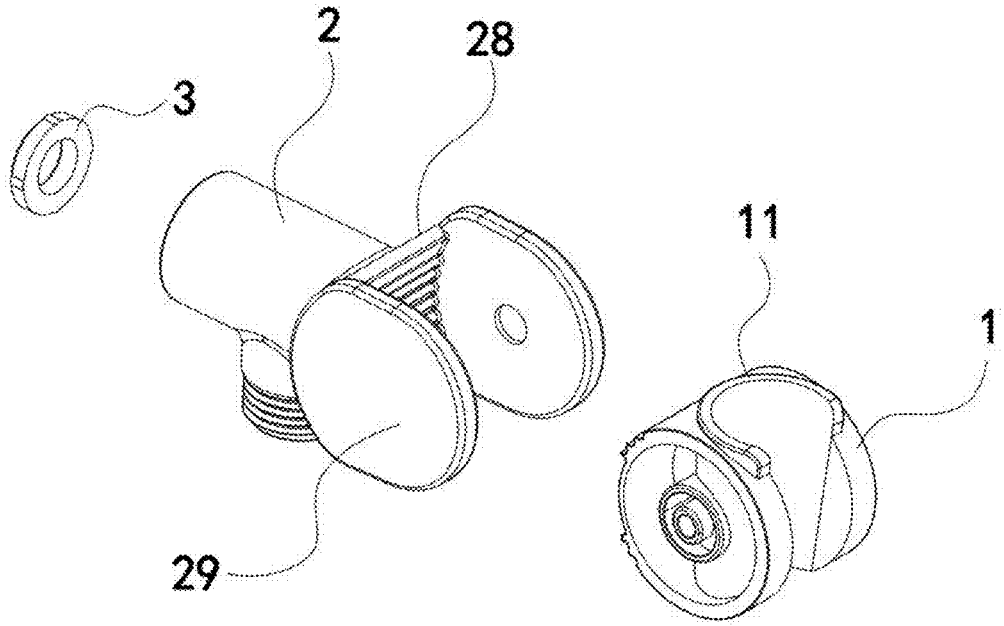
FIG. 3 shows an explosion diagram of an embodiment of the present invention.
Figure 4:
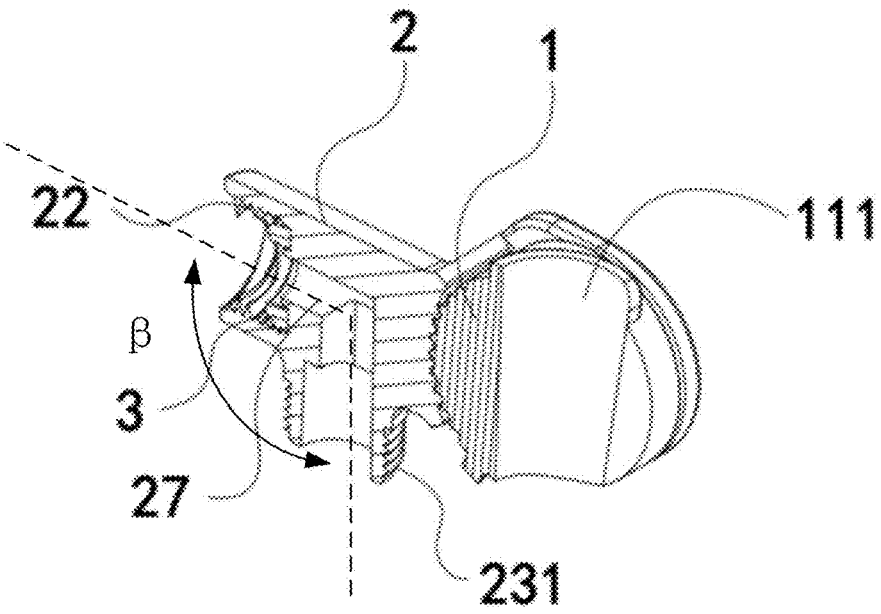
FIG. 4 shows a cross-sectional view of an embodiment of the present invention.

Referring to FIGS. 3 and 4, in some embodiments, the second connecting part 11 further comprises an open cavity, a diameter of an upper opening of the open cavity is larger than a diameter of a lower opening of the open cavity. In one embodiment, the diameter of an upper opening of the open cavity is about 1.1~1.2 times larger than the diameter of a lower opening of the open cavity. So that the hand-held shower head can be stably plugged into the plug-in element 1.

When showering, a rotating angle of the hand-held shower head can be adjusted by adjusting the rotating angle of the plug-in element 1. The rotating angle of the plug-in element 1 can be limited by a stop block 12 located on a lower end of the plurality of positioning tooth 14, otherwise the water emerging from the hand-held shower head can be disordered and affect the using experience of the user. The stop block 12 can be stuck at the first end 28, when the plug-in element 1 rotates certain degrees around the rotation shaft 13. Thus, the rotating angle of the plug-in element 1 can be limited.

Referring to FIG. 5, in order to make sure that the plurality of positioning teeth 14 can rotate on the plurality of fitting teeth 25 freely. In one embodiment, both ends of the plurality of the positioning teeth 14 comprises a groove 15. The groove 15 is used to prevent a ratcheting between the plurality of positioning teeth 14 and the plurality of fitting teeth 25 from being too saturated. An arc length of the plurality of the positioning teeth 14 is greater than an arc length of the groove 15. In one embodiment, the arc length of the groove 15 is about 0.5~0.6 times as lager as the arc length of the plurality of the positioning teeth 14. A width of the groove 15 should also not be too large, otherwise the engagement force between the plurality of positioning teeth 14 and the plurality of fitting teeth 25 will be greatly increased, and the overall structure can be loosen. Preferably, the width of the plurality of positioning teeth 14 is defined as W, and the width of the groove 15 is defined as w, wherein w ranges from about 1/10 W to about 1/6 W. In one embodiment, w is about 1/8 W.

Figure 7:
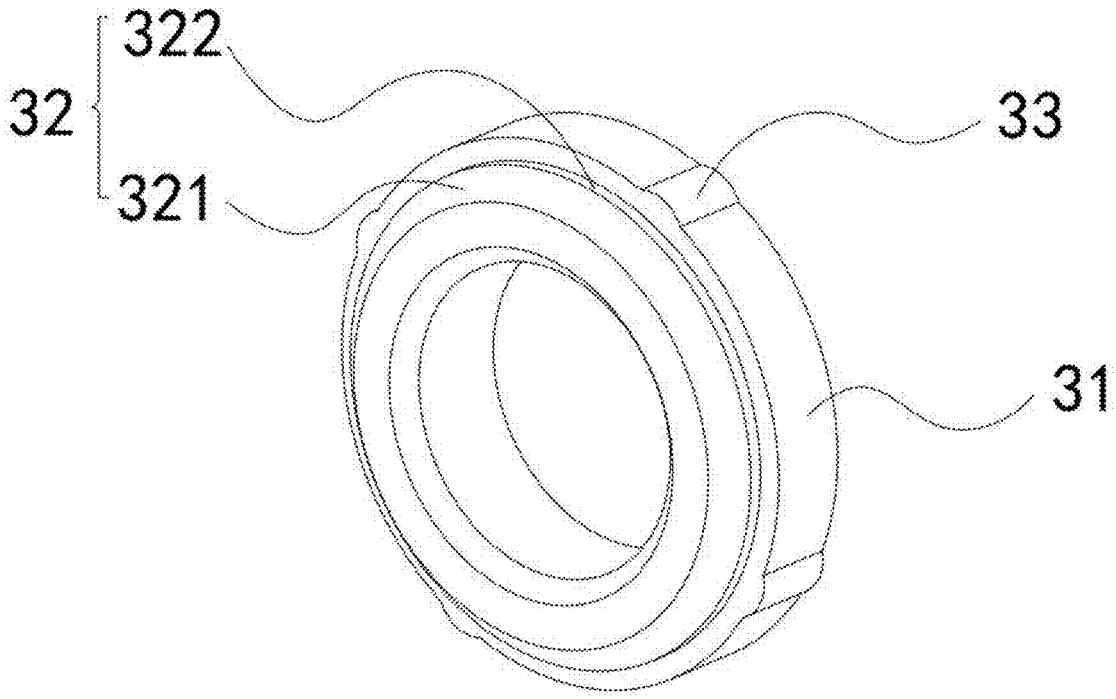
FIG. 7 shows an elevation view of a gasket according to an embodiment of the present invention.
Figure 8:
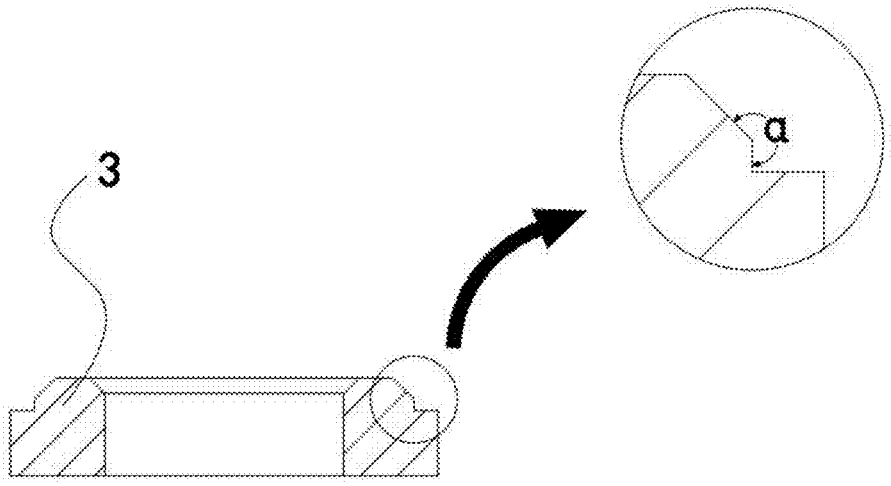
FIG. 8 shows a cross-sectional view of a gasket according to an embodiment of the present invention.

Referring to FIGS. 7 and 8, in one embodiment, in order to prevent from water leakage, the gasket 3 further comprises a pad part 31 and a guide part 32 connected to the pad part 31. The guide part 32 comprises a vertical outside surface 321 and a inclined outside surface 322. A angle α between the vertical outside surface 321 and the inclined outside surface 322 ranges from 270 degrees to 200 degrees. More preferably, the angle α between the vertical outside surface 321 and the inclined outside surface 322 ranges from 240 degrees to 210 degrees. In one embodiment, the angle α between the vertical outside surface 321 and the inclined outside surface 322 is about 225 degrees.

In one embodiment, the gasket 3 further comprises a plurality of stabilizer parts 33 uniformly located on the outer peripheral ring of the pad part 31. A number of the stabilizer parts 33 preferably arranges from 2 to 10. In one embodiment, four stabilizers 33 are included, arranged symmetrically. The plurality of stabilizer parts 33 allow the gasket 3 to be stably received in the water inlet part 21 without falling off, ensuring that the gasket 3 can seal the gap between the outer water inlet and the water inlet part 21. In one embodiment, a material of the gasket 3 comprises a highly elastic sealing silicone.

The above exemplary description of the present disclosure is provided in conjunction with the accompanying drawings. It is evident that the specific implementation of the present disclosure is not limited by the aforementioned modes. As long as various non substantial improvements are made using the method concept and technical solutions of the present disclosure, or when the concept and technical solutions of the present disclosure are directly applied to other occasions without improvement, they are all within the scope of protection of the present disclosure.

What is claimed is:

1. A shower holder, comprising:

a main body comprising a water inlet part, a water outlet part, and a first connecting part located away from the water inlet part, and the first connecting part comprising a plurality of fitting teeth arranged uniformly;

a plug-in element comprising a second connecting part, and a plurality of positioning teeth uniformly distributed on an outside of the second connecting part, wherein the plurality of positioning teeth are provided corresponding to the plurality of fitting teeth so that the plug-in element is rotatably connected to the main body; and a gasket located on the water inlet part, wherein the gasket comprises a gasket body and a guide part connected to the gasket body, a stable connection between the main body and an outer water inlet is formed by the guide part.

2. The shower holder according to claim 1, wherein an inside wall of the water inlet part away from the first connecting part comprises an internal thread.

3. The shower holder according to claim 1, wherein the main body further comprises a water passage which passes through the water inlet part and the water outlet part, the water outlet part comprises an external thread.

4. The shower holder according to claim 1, wherein an angle β is formed between an axis of the water inlet part and an axis of the water outlet part, the angle β ranges from 80 degrees to 120 degrees.

5. The shower holder according to claim 1, wherein the first connecting part comprises an first end and two connection ends respectively located at two sides of the first end, the first end being connected to the water inlet part, and the plurality of the fitting teeth are located on a side wall of the first end away from the water inlet part.

6. The shower holder according to claim 5, wherein a side wall of the first end is a first circular arc surface, and the plurality of fitting teeth are uniformly distributed on the first circular arc surface.

7. The shower holder according to claim 6, wherein an outside wall surface of the plug-in element is a second circular arc surface corresponding to the first circular arc surface, and the plurality of the positioning teeth are uniformly distributed on the second circular arc surface.

8. The shower holder according to claim 5, wherein each of the connection ends comprises a rotation shaft hole, and the plug-in element further comprises a rotation shaft rotatably connected to the rotation shaft hole.

9. The shower holder according to claim 1, wherein the second connecting part comprises an open cavity, a diameter of an upper opening of the open cavity is larger than a diameter of a lower opening of the open cavity.

10. The shower holder according to claim 9, wherein a plug-in element further comprises a stop block located on the lower end of the plurality of positioning tooth.

11. The shower holder according to claim 9, wherein both ends of the plurality of the positioning teeth comprises a groove, an arc length of the plurality of the positioning teeth is greater than an arc length of the groove.

12. The shower holder according to claim 1, wherein a material of the gasket comprises an elastic sealing silicone.

* * * * *